United States Patent [19]

Dysart

[11] 3,952,815

[45] Apr. 27, 1976

[54] LAND EROSION PROTECTION ON A ROCK CUTTER

[75] Inventor: Theodore Rivers Dysart, Dallas, Tex.

[73] Assignee: Dresser Industries, Inc., Dallas, Tex.

[22] Filed: Mar. 24, 1975

[21] Appl. No.: 561,576

[52] U.S. Cl. ..... 175/374; 175/337

[51] Int. Cl.[2] ..... E21C 13/01; E21B 9/35

[58] Field of Search ..... 175/374, 375, 410, 411, 175/329

[56] References Cited

UNITED STATES PATENTS

| | | | |
|---|---|---|---|
| 2,121,202 | 6/1938 | Killgore | 175/374 X |
| 3,126,067 | 3/1964 | Schumacher | 175/374 |
| 3,140,748 | 7/1964 | Engle et al. | 175/410 |
| 3,389,761 | 6/1968 | Ott | 175/374 |
| 3,461,983 | 8/1969 | Hudson et al. | 175/375 |
| 3,628,616 | 12/1971 | Neilson | 175/375 |
| 3,727,705 | 4/1973 | Newman | 175/374 |
| R3,690 | 10/1869 | Leschot | 175/410 X |

*Primary Examiner*—Frank L. Abbott
*Assistant Examiner*—Richard E. Favreau
*Attorney, Agent, or Firm*—Eddie E. Scott

[57] ABSTRACT

Cone shell erosion between inserts is substantially reduced by positioning small, flat-topped compacts in the vulnerable cutter shell areas. At least one row of substantially outwardly projecting formation contacting inserts are located on the rock cutter. A row of substantially flush compacts are embedded in the cutter shell alternately positioned between the outwardly projecting formation contacting inserts.

6 Claims, 2 Drawing Figures

LAND EROSION PROTECTION ON A ROCK CUTTER

BACKGROUND OF THE INVENTION

The present invention relates to the art of earth boring and, more particularly, to a bit having land erosion protection on the cutter. During the drilling of boreholes with an insert type bit, the body of the cutter operates in a highly abrasive environment. This abrasive condition exists during drilling operations wherein a drilling mud is utilized as the medium for cooling the bit and carrying the cuttings from the borehole and during drilling operations wherein an air or gas is used as the circulating, cooling and flushing medium.

Bit life and efficiency are of prime importance in the drilling of oil and gas wells, blast holes, raise holes or other types of boreholes, since the penetration rate is more or less directly related to the condition of the bit. When harder formations are encountered during the drilling of the borehole, a bit having carbide inserts projecting from the body of the cutter is generally utilized because of the ability of the inserts to penetrate the hard formations of the earth. However, the carbide inserts are mounted in a relatively soft metal forming the body of the cutter membrane. When such bits are exposed to the abrasive conditions in the borehole, the relatively soft material of the cutter member body which holds the inserts in place is abraded or eroded away. This is primarily due to the presence of relatively fine cuttings from the formation and/or the direct blasting effect of the fluid utilized in the drilling process. The wearing away of the cutter member body is usually most pronounced along the gage row of the cutter members. When the material supporting the inserts is eroded or abraded away to a sufficient extent, the drilling force exerted on the insert, when they engage the formation, either breaks the inserts or forces them out of the cutter member altogether, with the result that the bit is no longer effective in cutting the formation.

When drilling in certain abrasive type formations where the bit is penetrating at a rapid rate, it can be expected that the abrasive formation will be contacting the cone shell on the areas between the inserts due to the depth of penetration of the individual cutting inserts. When this cone shell contact occurs, the softer cone shell material will erode away around the harder insert materials until the insert becomes exposed and the retention in the cone shell is weakened, thus resulting in the loss of the insert and reduction of bit life. The inserts utilized in this type of bit are retained in the cutter member by "hoop" tension generated when the insert is pressed into the relatively soft cutter member body. Accordingly, any method utilized in attempting to alleviate the erosion of the cutter member must take into consideration that the "hoop" tension holding the insert must be retained.

DESCRIPTION OF PRIOR ART

In U.S. Pat. No. 3,461,983 to Lester S. Hudson and Eugene G. Ott, assigned to Dresser Industries, Inc., patented Aug. 16, 1969, a cutting tool having a hard insert in a hole surrounded by hardfacing is shown. An apparatus that includes a member having a surface thereon exposed to an abrasive environment is shown. The member has a relatively hard insert pressed into a hole in the member with a hardfacing material on the surface of the member surrounding the insert. A method of manufacturing the apparatus is described wherein the hole is plugged and the hardfacing material is applied to the surface around the plug. After the hardfacing material has been permanently bonded to the surface, the plug is removed and the hard insert pressed into the hole to complete the apparatus.

In U.S. Pat. No. 3,513,728 to Lester S. Hudson and Eugene G. Ott, assigned to Dresser Industries, Inc., patented May 26, 1970, a method for manufacturing apparatus useful in an abrasive environment is shown. The apparatus includes a member having a surface thereon exposed to an abrasive environment. The member has a relatively hard insert pressed into a hole in the member and a hardfacing material on the surface of the member surrounding the insert. The method of manufacturing the apparatus wherein the hole is plugged and hardface material is applied to the surface around the plug is described. After the hardfacing material has been permanently bonded to the surface, the plug is removed and the hard insert pressed into the hole to complete the apparatus.

SUMMARY OF THE INVENTION

The present invention retards cutter shell erosion on a rock cutter by including small, substantially flush compacts positioned in the vulnerable cutter shell areas. Certain of these areas were not originally expected to suffer wear because it was expected that the cutter shell would be held away from the formations in firm formations by the insert extension. However, when tooth-shaped insert bits came into common usage in softer formations and full insert penetration was encountered, the expectation no longer applied. Current high penetration rates with tooth-shaped insert bits has made cutter shell erosion a significant factor in limiting bit life, and a simple, economical method of protecting the valuable cutter shell is sorely needed.

The bit of the present invention includes a rolling cutter body with a row of substantially outwardly projecting cutting inserts projecting from said body with said inserts being circumferentially spaced. A row of substantially flush inserts are embedded in the cutter body with the flush inserts being alternately located between the outwardly projecting cutting inserts. In one embodiment of the invention, small compacts are positioned in the areas between the gage row cutting inserts which roll down to a position adjacent to the wall at the bottom corner of the borehole where the mass of cuttings on bottom tend to squeeze between the gage row inserts and the borehole wall creating a heavy, abrasive action. Current high penetration rates with tooth-shaped compact bits has made cutter shell erosion a significant factor in limiting bit life, and the present invention for protecting the valuable cutter shell provides a simple, economical means of protecting the valuable cutter shell. The above and other features and advantages of the present invention will become apparent upon consideration of the following detailed description of the invention when taken in conjunction with the accompanying drawings.

DETAILED DESCRIPTION OF THE INVENTION

Figure 1:
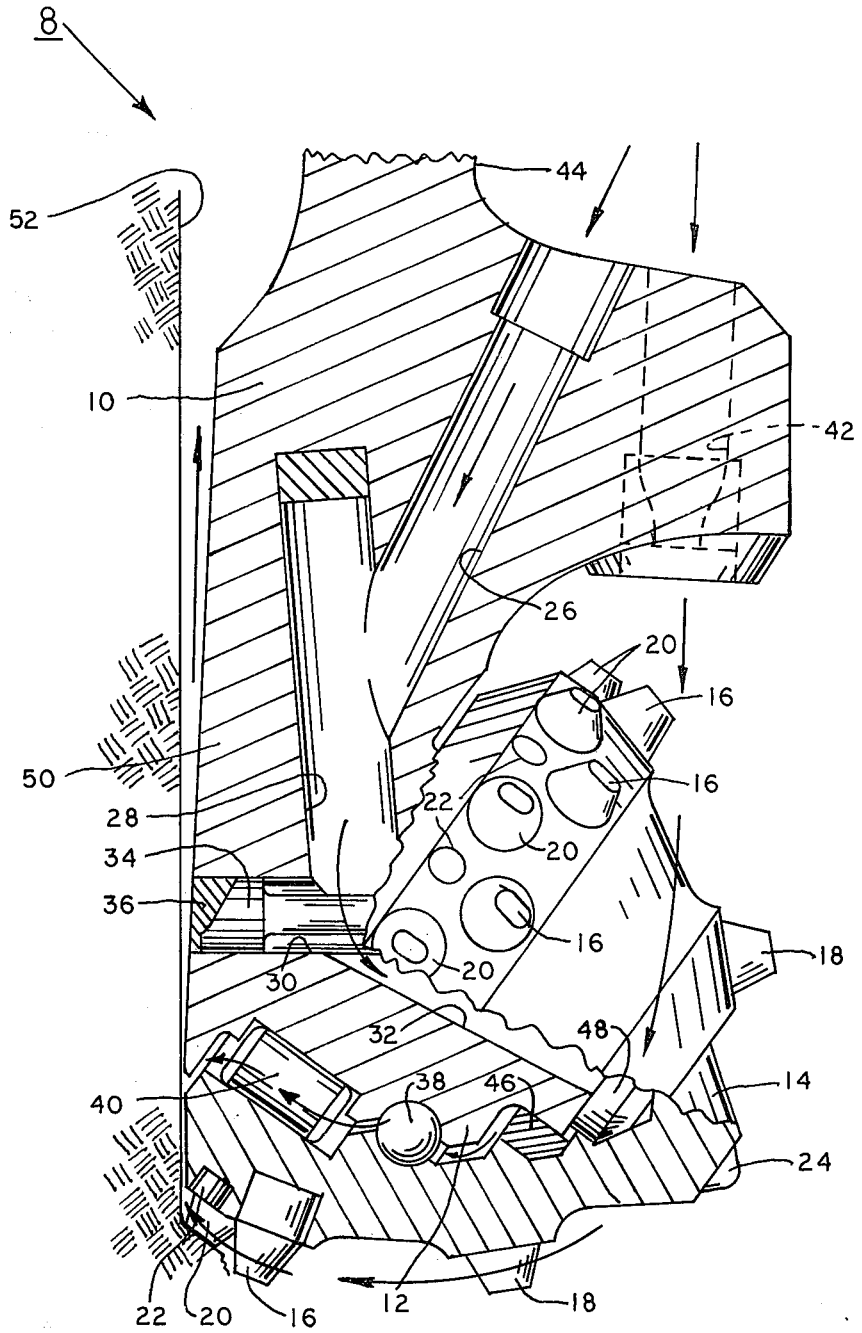
FIG. 1 illustrates a three cone rock bit constructed in accordance with the present invention.

Referring now to the drawings and, in particular, to FIG. 1, an earth boring bit generally designated by the reference number 8 is shown. The bit 8 includes a main bit body 10 supporting three rotatable conical cutter members with cutter member 14 being shown in FIG. 1. Each of the cutter members is arranged so that its axis of rotation is oriented generally toward the center line of the bit 8 which coincides with the longitudinal axis of the borehole 52.

A central passageway 44 extends downwardly into the bit body 10. The bit body 10 also includes an external threaded pin portion for allowing the bit 8 to be connected to the lower end of a string of hollow drill pipe. A depending arm 50 is provided with a journal portion or bearing 12 for rotatably supporting the cutter member 14. Each of the three arms of the bit 8 terminates in a shirt tail that is disposed in close proximity to the wall of borehole 52.

The rotary cone cutter 14 is mounted on the bearing pin 12. The cone cutter 14 includes an internal cavity for receiving the bearing pin 12. Bearing means are provided between the cone cutter 14 and bearing pin 12 within the internal cavity. The bearing means include a system of roller bearings 40, a system of ball bearings 38, a friction bearing 46 and a thrust button 48. A multiplicity of tungsten carbide inserts 16, 28, 20 and 24 are embedded in the outer surface of the cone cutter 14 for disintegrating the formations as the bit is rotated and moved downward. Small, flat-top (or slightly rounded or pointed) compacts 22 are positioned in the areas between the gage row cutting inserts 20 which roll down to a position adjacent to the wall at the bottom corner of the borehole 52 where the mass of cuttings on bottom tend to squeeze between the gage row inserts 20 and the borehole wall creating a heavy, abrasive action. Current high penetration rates with tooth-shaped compact bits has made cone shell erosion a significant factor in limiting bit life, and the present invention for protecting the valuable cone shell provides a simple, economical means of protecting the valuable cone shell.

Drilling fluid is forced downward through the center of the hollow drill pipes, passing into the central cavity 44. Passages 26 and 42 divide the flow of fluid passing from the cavity 42 into two distinct streams. One of the streams flows downwardly through the passage 42 through a nozzle and is directed between the cutters to the bottom of the borehole. The other stream of fluid flows downwardly through passage 26 into passage 28 and into bores 30 and 32 wherein it is directed to cool the bearings that are operably disposed between the bearing pin 12 and the relatively rotatable cutter member 14. Comparatively, a relatively small volume of the circulating fluid flows through the cooling passageways 26, 28, 30 and 32 to the bearings, while a relatively large volume at high velocity flows through the passage 42 cleaning the borehole 52 and carrying the cuttings to the surface.

As might be expected, the cutter 14 is subjected to the direct blast of fluid flowing through passage 42 as well as to the effect of the fluid deflected from the bottom of the borehole 52. Also, the cutter 14 is rotating continuously in the cuttings generated as the cutter members engage the bottom of the borehole 52. Thus, the cutter members are subjected to extremely abrasive and/or erosive conditions that tend to wear, erode or abrade the material forming the cutter members. When drilling in relatively soft, abrasive formations where the bit is penetrating at a rapid rate, it can be expected that the abrasive formations will be contacting the cone shell on the areas between the inserts due to the depth of penetration of the individual carbide cutting inserts. When the cone shell contact occurs, the softer cone shell material will erode away around the harder insert material until the insert becomes exposed and the retention in the cone shell is weakened, thus causing the loss of the compact and reduction of bit life.

The structural details of an earth boring bit 8 constructed in accordance with the present invention having been described, the operation of the bit 10 will now be considered with reference to FIG. 1. The bit 8 is connected at the lowest member of a rotary drill string. A gaseous drilling fluid is circulated through the drill string into the internal chamber 44 in the bit 8. A portion of the gaseous drilling fluid passes from internal chamber 44 through passage 26, passage 28, and bores 30 and 32. This portion of the gaseous drilling fluid is directed into the internal cavity in the cone cutter 14 to cool the bearings and flush any foreign materials from the bearing area. The other portion of the drilling fluid passes through passage 42 to the bottom of the borehole. The inserts 16, 18, 20 and 24 in the cone cutter 14 serve to disintegrate the formations and form the desired borehole.

Conditions often exist where the pressure and volume of the circulating drilling fluid is inadequate for flushing of the cuttings from the borehole. Under these conditions, the cuttings generated by the action of the bit on the bottom of the borehole are not efficiently lifted off the bottom, and they tend to fall back to the bottom until a time when regrinding by the bit reduces the individual particles to a size small enough to be lifted by the circulating fluid. It can readily be appreciated that the bit will be working in a bed of cuttings under these conditions. The cutter 14 is also subjected to the direct blast of fluid flowing through passage 42 as well as to the effect of the fluid deflected from the bottom of the borehole 52.

The cutter 14 is subjected to extremely abrasive and/or erosive conditions that tend to wear, erode or abrade the material forming the cutter member 14. When drilling in relatively soft, abrasive formations where the bit 14 is penetrating at a rapid rate, it can be expected that the abrasive formations will be contacting the cone shell on the areas between the inserts due to the depth of penetration of the individual carbide cutting inserts. When the cone shell cntact occurs, the softer cone shell material will erode away around the harder insert material until the insert becomes exposed and the retention in the cone shell is weakened, thus causing the loss of the compact and reduction of bit life. The small, flat-top compacts 22 that are positioned in the areas between the gage row cutting inserts 20 protect the inserts 20. When the inserts 20 roll down to a position adjacent to the wall at the bottom corner of the borehole 52, the mass of cuttings on bottom tend to squeeze between the gage row inserts 20 to the borehole wall creating a heavy, abrasive action. Current high penetration rates with tooth-shaped insert bits has made cone shell erosion a significant factor in limiting bit life. The present invention protects the valuable cone shell and provides a simple, economical means of preventing the inserts 20 from being lost during drilling.

Figure 2:
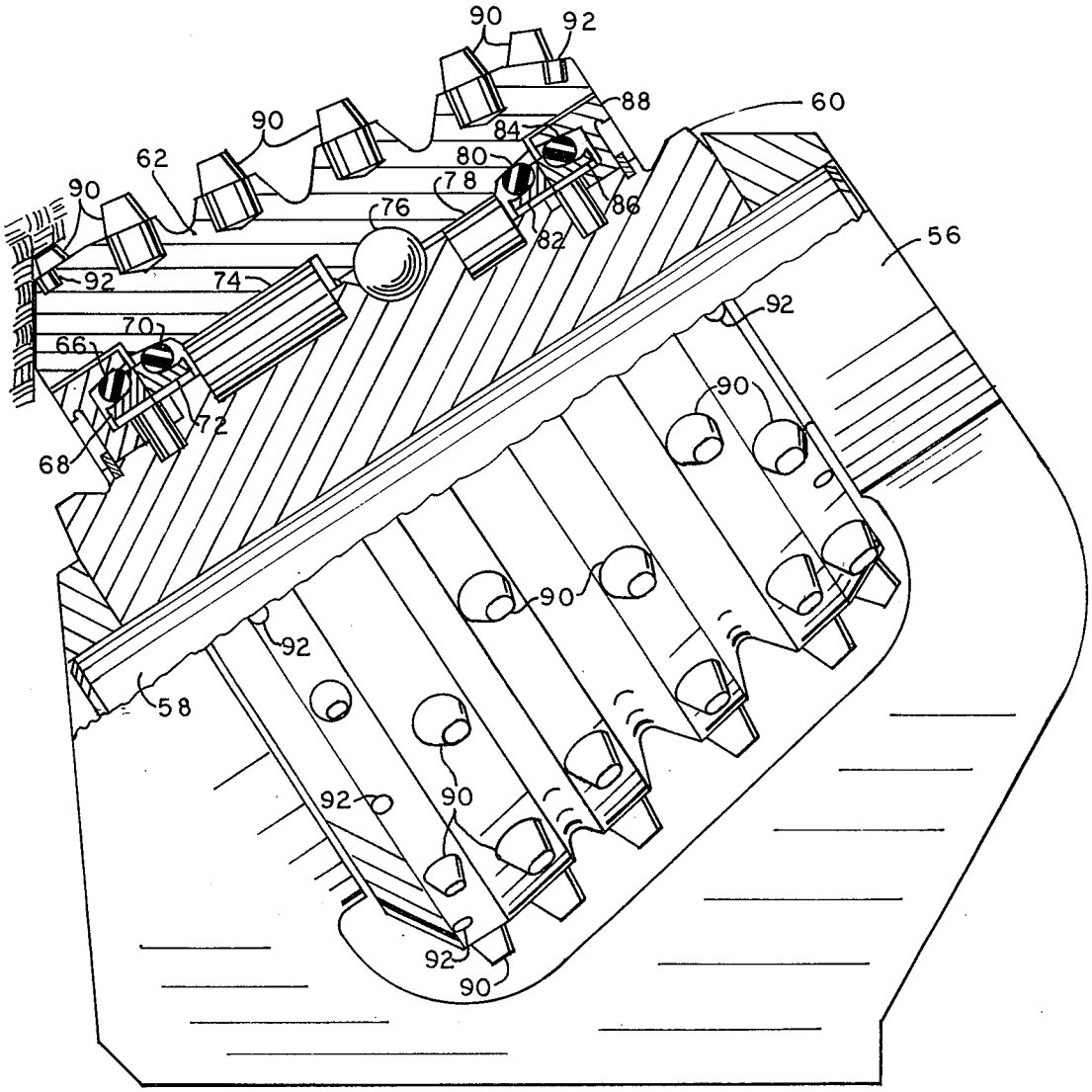
FIG. 2 illustrates a raise bit cutter constructed in accordance with the present invention.

Referring now to FIG. 2, a second embodiment of a cutter constructed in accordance with the present invention is illustrated. The cutter is generally designated by the reference number 54. The cutter 54 includes a multiplicity of outwardly projecting carbide inserts 90 for contacting and disintegrating the earth formations. The carbide inserts 90 are mounted in a cutter shell 62. The cutter shell 62 is positioned around a bearing shell 60 and bearing shell 60 is securely locked in a saddle 56. The saddle 56 may be connected to the rotary head of an earth boring machine or to the body of an earth boring bit.

The bearing shell 60 is locked in position in the saddle 56 by main pin 58. The bearing shell 60 remains firmly locked in place throughout the drilling operation due to a tenon and groove arrangement disclosed in U.S. Pat. No. 3,203,492 to C. L. Lichte, assigned to Dresser Industries, Inc., patented Aug. 31, 1965. A multiplicity of bearing systems including a series of ball bearings 76, a series of inner roller bearings 74 and a series of outer roller bearings 78 promote rotation of the cutter shell 62 about the bearing shell 60. Lubricant is retained in the bearing area by two sets of seal elements. The inner set of seal elements includes a pair of annular metal seal rings 68 and 72 that are positioned near the inner end of the cutter 54. A flexible rubber O-ring 66 is positioned between seal ring 58 and an annular extension 64 of the bearing shell 60 to retain the seal ring 68 in the desired position and resiliently urge seal ring 68 against seal ring 72. A flexible rubber O-ring 70 is positioned between the cutter seal shell 62 and the seal ring 72 to retain the seal ring 72 in the desired position and resiliently urge the seal ring 72 against seal ring 68. The outer set of seal elements includes a pair of annular metal seal rings 82 and 86 that are positioned near the outer end of the cutter 54. A flexible rubber O-ring 84 is positioned between the seal ring 86 and an annular extension 88 of the bearing shell 60 to retain the seal ring 86 in the desired position and resiliently urge seal ring 86 against seal ring 82. A flexible rubber O-ring 80 is positioned between the cutter shell 62 and seal ring 82 to retain seal ring 82 in the desired position and resiliently urge seal ring 82 against seal ring 86.

The carbide inserts 90 contact and disintegrate the formations during the drilling operation. A multiplicity of small, flat-topped compacts 92 are positioned in the areas between the cutting inserts 90 to protect the valuable cutter shell 62. Cone shell erosion has become a significant factor in limiting cutter life, and the present invention for protecting the valuable cutter shell provides a simple and economical means of protecting the valuable cutter shell.

The structural details of an earth boring cutter 54 constructed in accordance with the present invention having been described, the operation of the cutter 54 will now be considered with reference to FIG. 2. The bit is connected to a rotary unit of an earth boring machine such as the rotary head of a tunneling machine or the raise bit body of a large diameter raise bit. The inserts 90 in the cutter shell 62 serve to disintegrate the formations and form the desired hole.

The cutter 54 is subject to extremely abrasive and/or erosive conditions that tend to wear, erode or abrade the material forming the cutter shell 62. When drilling in relatively soft, abrasive formations where the cutter 54 is penetrating at a rapid rate, it can be expected that the abrasive formation will be contacting the cutter shell 62 on the areas between the inserts 90 due to the depth of penetration of the individual carbide cutting inserts 90. When this cutter shell contact occurs, the softer cutter shell material will erode away around the harder insert material until the insert becomes exposed and the retention in the cutter shell is weakened, thus causing the loss of the insert and reduction of cutter life. The small, flat-topped compacts 92 that are positioned between the cutting inserts 90 protect the cutter shell 62 and inserts 90. The present invention protects the valuable cutter shell 62 and provides a simple and economical means of preventing the inserts 90 from being lost during the earth boring operation.

The embodiments of the invention in which an exclusive property or privilege is claimed are defined as follows:

1. Apparatus for forming boreholes that is useful in an abrasive environment, said apparatus including:

a rotary cutter member mounted for rotation about a bearing element, said rotary cutter member having a cutter member body and a surface exposed to said environment, a circumferential row of cutting inserts projecting from said surface, said row including a multiplicity of individual inserts spaced apart, said inserts projecting from said body; and a multiplicity of land erosion protection inserts embedded in said body substantially flush with said surface and alternately positioned between said cutting inserts.

2. Apparatus useful in drilling boreholes or the like in an abrasive environment, comprising:

a main body having a bearing element;

at least one rotary cutter member mounted on said bearing element adapted to engage the formations encountered during the drilling of the borehole, said cutter member having a surface exposed to said environment;

at least one circumferential row of cutting inserts embedded in said cutter member, said cutting inserts projecting substantially outward from said surface and being spaced apart; and a multiplicity of land erosion protection inserts embedded in said cutter member, said land erosion protection inserts substantially flush with said surface and positioned alternately between said cutting inserts.

3. A rolling cutter member having a body with at least one annular row of outwardly projecting, circumferentially-spaced inserts embedded in said body and a multiplicity of substantially flush inserts embedded in said body in said annular row circumferentially-spaced between said outwardly projecting inserts.

4. A rotary rock bit for forming a well bore or the like, comprising:

a bit body having at least one bearing pin;

a rolling cone cutter body rotatably mounted upon said bearing pin;

an annular row of outwardly projecting, circumferentially-spaced inserts embedded in said cutter body; and a multiplicity of substantially flush inserts embedded in said cutter body in said annular row circumferentially-spaced between said outwardly projecting inserts.

5. A rolling cone cutter having a body with an annular row of substantially outwardly projecting cutting inserts embedded in said body, said inserts being circumferentially spaced, and an annular row of substantially flush inserts embedded in said body with said flush inserts being located between said outwardly projecting cutting inserts.

6. A rotary rock bit for forming a well bore or the like, comprising:

a bit body having at least one bearing pin;

a rolling cone cutter body rotatably mounted upon said bearing pin;

an annular row of substantially outwardly projecting cutting inserts embedded in said cutter body, said inserts being circumferentially spaced; and an annular row of substantially flush inserts embedded in said cutter body with said flush inserts being alternately located between said outwardly projecting cutting inserts.

* * * * *